US012503869B2

(12) United States Patent
Tadus et al.

(10) Patent No.: US 12,503,869 B2
(45) Date of Patent: Dec. 23, 2025

(54) RAILING BASE FOR A SAFETY RAILING STRUCTURE, GUARDRAILS

(71) Applicant: TRACTEL Inc. U.S.A., Houston, TX (US)

(72) Inventors: Jacek Tadus, Longmont, CO (US); Keith Yiu Tung Tong, Toronto (CA)

(73) Assignee: TRACTEL INC. U.S.A., Houston, TX (US)

( * ) Notice: Subject to any disclaimer, the term of this patent is extended or adjusted under 35 U.S.C. 154(b) by 340 days.

(21) Appl. No.: 18/111,344

(22) Filed: Feb. 17, 2023

(65) Prior Publication Data

US 2024/0279941 A1 Aug. 22, 2024

(51) Int. Cl.
*E04G 21/32* (2006.01)
*E04H 17/22* (2006.01)

(52) U.S. Cl.
CPC ..... *E04G 21/3238* (2013.01); *E04H 17/22* (2013.01)

(58) Field of Classification Search
CPC ..... E04G 21/3238; E04G 21/3233; E01F 13/022; E04H 17/22
See application file for complete search history.

(56) References Cited

U.S. PATENT DOCUMENTS 5,188,342 A 2/1993 Ouellette et al.
7,631,409 B2 12/2009 Dehlsen
D625,433 S * 10/2010 Preston ..... D25/133
9,376,832 B2 6/2016 Deering
9,464,452 B2 * 10/2016 Higgs ..... E04H 12/2238
D831,860 S * 10/2018 MacKarvich ..... D25/38.1
11,781,338 B2 * 10/2023 Hawthornthwaite ..... E04H 12/2215 256/31
2017/0152674 A1 * 6/2017 MacKarvich ..... E04G 21/3238

FOREIGN PATENT DOCUMENTS

CA 2 582 880 9/2008
EP 2 525 019 11/2012
FR 3 084 094 1/2020
GB 2 530 166 * 3/2016 ..... E01F 13/022
WO WO 2008/017836 * 2/2008 ..... E01F 13/022

* cited by examiner

*Primary Examiner* — Michael P Ferguson
(74) *Attorney, Agent, or Firm* — NIXON & VANDERHYE

(57) ABSTRACT

A railing base includes one rail post receptor and one counterweight receptor. The rail post receptor accommodates 1-4 railing posts. The counterweight receptor includes a hollow bottom allowing water drainage. The rail post receptor includes four upper receiving holes open towards the top, each configured to receive by insertion and to hold upright a railing post of a guardrail. The counterweight receptor accommodates concrete paver stones each of same determined square shape and size and stacked one on top of the other. The counterweight receptor is delimited at the bottom by a horizontal soleplate and laterally by four vertical side walls perpendicular to the soleplate. The side walls are adjusted to border and retain laterally the concrete paver stones. The counterweight receptor is open towards the top. The rail post receptor is arranged along one corresponding side wall of the counterweight receptor, the railing base being sheet metal.

20 Claims, 3 Drawing Sheets

RAILING BASE FOR A SAFETY RAILING STRUCTURE, GUARDRAILS

BACKGROUND OF THE INVENTION

Field of the Invention

The invention relates to a railing base for a safety railing structure and corresponding guardrails. The railing bases and guardrails are assembled together in a removable manner to assemble the safety railing structure that can be later dismounted for use in another place and/or with another guardrail perimeter shape. It has applications in providing safety means for operators working in elevated places, notably in a non-penetrating roof top application.

Description of the Related Art

Safety railing structures that are removable are already known and documents FR3084094, U.S. Pat. No. 5,188,342, CA2582880, U.S. Pat. Nos. 7,631,409, 9,376,832, EP2525019, are disclosing such safety railing structures.

The invention is intended to provide an improved safety railing structure. The improvements are due notably to the light weight of the railing base, allowing for easy setup and alignment prior to placement of heavy ballast weight. The heavy ballast weight is obtained using a plurality of concrete paver stones that are readily available and are, for each one, portable. The sheet metal railing base, especially the counterweight receptor, ensures that even if the concrete paver stone cracks it remains encapsulated in the counterweight receptor and therefore the stability of the system is not compromised.

SUMMARY OF THE INVENTION

Therefore, one object of the invention is to provide a railing base for a safety railing structure, the railing base comprises one rail post receptor and one counterweight receptor, the rail post receptor is configured to accommodate between one and four railing posts and the counterweight receptor comprises a hollow bottom to allow for water drainage, the rail post receptor comprises four upper receiving holes open towards the top, each upper receiving hole being configured to receive by insertion and to hold upright a railing post of a guardrail, the counterweight receptor is configured to accommodate concrete paver stones each of same determined square shape and size, the concrete paver stones being stacked one on top of the other in the counterweight receptor, the counterweight receptor being delimited at the bottom by a horizontal soleplate and laterally by four vertical side walls perpendicular to the soleplate, the four side walls being adjusted as to border and retain laterally the concrete paver stones, the counterweight receptor being open towards the top, the rail post receptor is arranged along one side wall of the counterweight receptor, the railing base, being fabricated from sheet metal.

In various embodiments of the invention, the following means, which can be used alone or in any technically possible combination, are used:

- each upper receiving hole is configured to receive by vertical insertion, a lower end of the railing post of a guardrail, the railing post lower end shape being tubular, the upper receiving hole being open toward the top and having a shape corresponding to the cross-section shape that of the railing post lower end,

- the tubular railing post lower end has a circular cross-section,
- the rail post receptor is comprised of a horizontal upper retainer plate (=upper plate) having the upper receiving holes, the upper plate being horizontal and located at a level above the level of the soleplate,
- the upper plate is at the level of the upper end of the corresponding vertical side wall along which the rail post receptor is arranged,
- the rail post receptor further comprises, under the upper plate, of a horizontal lower retainer plate (=lower plate) which has four lower receiving holes, the lower plate being at a level above the level of the soleplate and under the level of the upper plate, the lower receiving holes and upper receiving holes being aligned vertically by pairs and being arranged as to allow a railing post lower end of a guardrail to be inserted into both receiving holes of the pair and be held upright,
- the upper plate is formed from sheet metal,
- the lower plate is profile cut from sheet metal,
- the upper plate and the lower plate are parts of the rail post receptor forming a single receptor for up to four guide rail post,
- the railing base is manufactured from individual formed sheet metal components that are shaped such that when the components are assembled together, they are welded together at their joining edges,
- the upper plate and the lower plate are welded to a vertical part of the rail post receptor and to a vertical side wall (18) of the counterweight receptor that closes the rail post receptor towards the counterweight receptor,
- the upper and lower plates of the rail post receptor have receiving holes of a slightly larger diameter than that of a railing post,
- the receiving holes in the upper and lower plates are aligned by pairs vertically to allow for the lower part of a railing post to be inserted and pass through two vertically aligned receiving holes of the upper and lower plates,
- the upper and lower receiving holes are integral in capturing and retaining the railing post in the upright position,
- the lower plate and the soleplate are joint after welding the components of the railing base,
- the rail post receptor comprises of releasable locking device(s) configured to lock in place the railing post lower end(s) of guardrail(s) inserted in the rail post receptor,
- the releasable locking devices of the rail post receptor are individual locking devices,
- the individual locking devices are bolts and nuts,
- in the case of individual locking devices, each releasable locking device is acting on one railing post lower end inserted into a pair of receiving holes,
- the individual locking devices are inserted and/or operated into individual slots of the rail post receptor,
- the releasable locking device of the rail post receptor is a common device, the releasable locking device acts on all the inserted railing post lower end(s) simultaneously,
- the railing base comprises toe board mounting retainers configured to receive by insertion and hold upright toe boards,
- the toe board mounting retainers are arranged along the side walls,
- the rail post receptor is closed at the periphery of the railing base by lateral walls, the toe board mounting retainers are arranged along lateral walls of the rail post receptor, at least two lateral walls of the rail post receptor are extensions of two opposite vertical lateral side walls of the counterweight receptor, the rail post receptor is closed towards the counterweight receptor by a vertical side wall (18) of the counterweight receptor, the soleplate of the counterweight receptor is discontinuous and comprises at least one opening, the main faces and of the rail post receptor and of the counterweight receptor (19) are made from one common sheet metal that is cut and bent, the main faces and plates of the rail post receptor and of the counterweight receptor are made from one common sheet metal that is cut and bent and the main faces and lower plate are also welded together, at least one from the main faces of the rail post receptor and of the counterweight receptor are made from a sheet metal that is welded to another part (notably another main face) of the railing base, the main faces are the soleplate, the four vertical side walls, the upper and lower plate(s), the lateral wall(s), the counterweight receptor is configured to receive and stack three concrete paver stones, each one being of approximative size 406 mm×406 mm×70 mm and of approximative weight 13.6 kg, each guardrail forms a vertical barrier element and comprises of two vertical railing posts and a set of horizontal bars, the set of horizontal bars being extended between the two vertical railing posts and comprising of a handrail between the upper ends of the two railing posts, each guardrail comprises of two vertical railing posts and two horizontal bars including the handrail.

A further object of the invention is to provide safety railing structure with guardrails and railing bases, the railing bases being according to the description and each guardrail comprises of two vertical railing posts and a set of horizontal bars, the set of horizontal bars being extended between the two vertical railing posts and comprising of a handrail between the upper ends of the two railing posts, each guardrail forming a vertical barrier element when the two railing posts lower ends of the guardrail are inserted in the rail post receptors of two railing bases.

In various embodiments, the safety railing structure with guardrails and railing bases further comprises toe boards. Advantageously, the toe boards are configured to be inserted and hold upright in toe board mounting retainers of the railing bases.

A still further object of the invention is to provide safety railing configured for a non-penetrating roof top application.

A still further object of the invention is to provide guardrails configured for a non-penetrating roof top application.

A still further object of the invention is to provide railing bases configured for a non-penetrating roof top application.

A still further object of the invention is to provide railing bases and guardrails configured for a non-penetrating roof top application.

The following description in relation with the appended drawings, given by way of non-limitative example, will allow a good understanding of what the invention consists of and of how it can be implemented.

DESCRIPTION OF THE PREFERRED EMBODIMENTS

Figure 2:
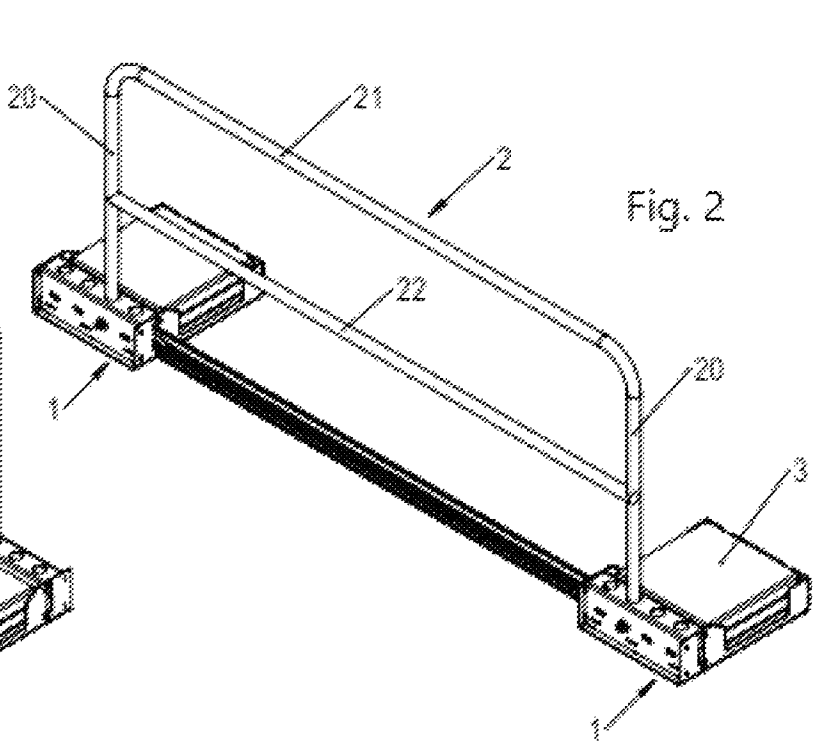
FIG. 2 is a perspective front view of the two railing bases holding a guardrail of FIG. 1.
Figure 1:
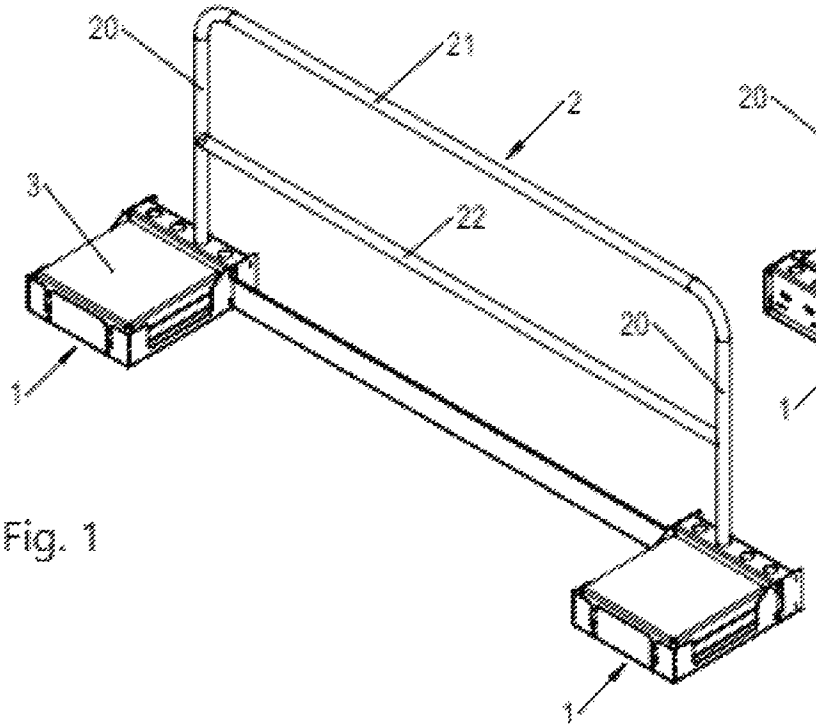
FIG. 1 is a perspective rear view of two railing bases holding a guardrail.
Figures 3, 4:
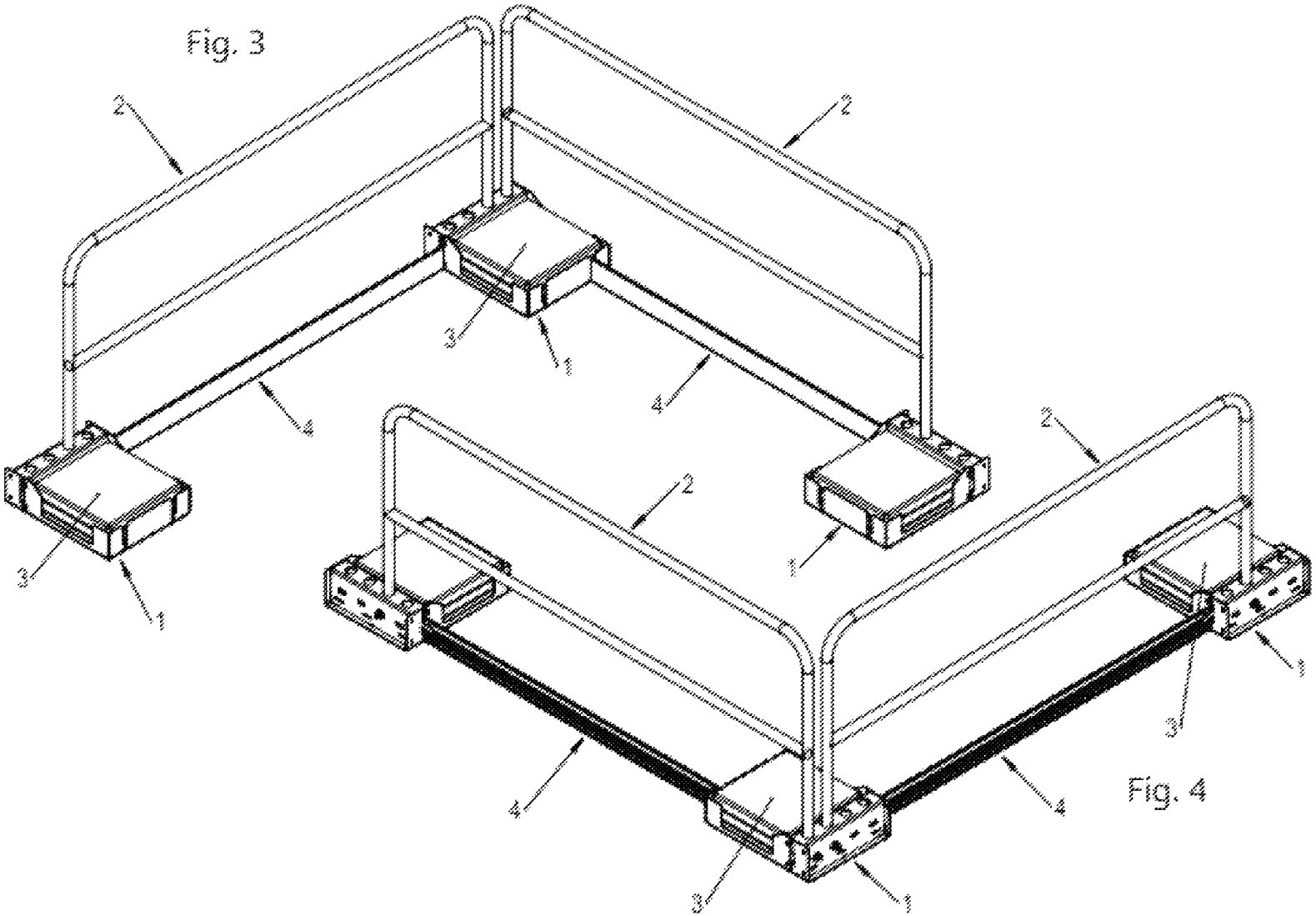
FIG. 3 is a perspective rear view of three railing bases holding two guardrails to define a railing corner.
FIG. 4 is a perspective front view of three railing bases holding two guardrails to define the railing corner of FIG. 3.
Figure 5:
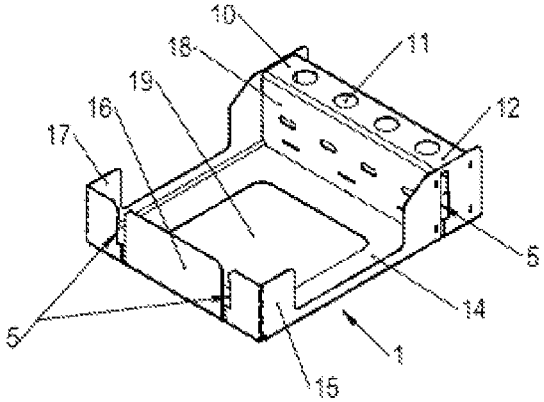
FIG. 5 is a perspective rear view of a railing base without concrete paver stones in the counterweight receptor.
Figure 6:
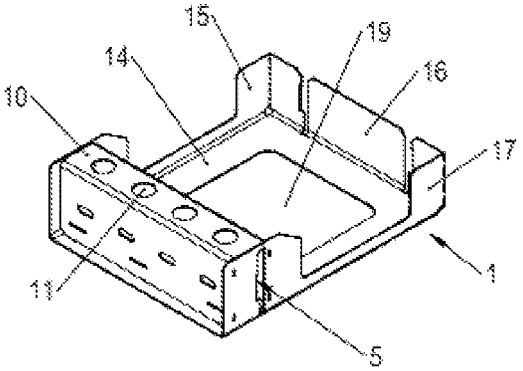
FIG. 6 is a perspective front view of a railing base without concrete paver stones in the counterweight receptor.
Figure 7:
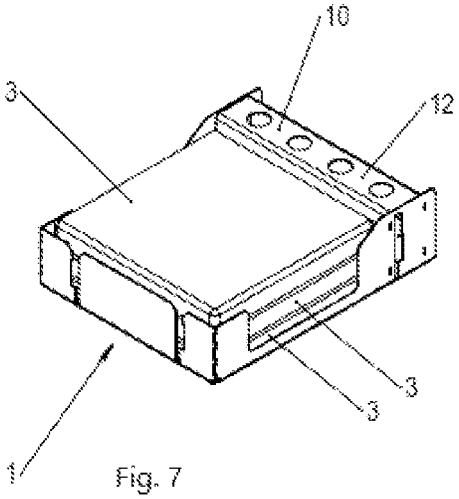
FIG. 7 is a perspective rear view of a railing base with three concrete paver stones in the counterweight receptor.
Figure 8:
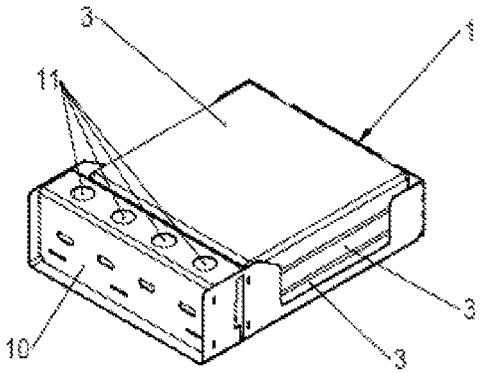
FIG. 8 is a perspective front view of a railing base with three concrete paver stones in the counterweight receptor.

The railing base design incorporates a novel idea of utilizing three readily available 16 inch (406 mm)×16 inch (406 mm) 30 lb (13.6 kg) concrete paver stones to achieve the necessary ballast weight needed to ensure railing stability. This allow the utilization of three comparatively lighter readily available paver stones which are easier to handle and place at installation rather than one whole weight of 90 lb-100 lb (40.8 kg).

The railing base weighs only 12.4 lb (5.6 kg) making it easy to carry and setup during installation of the safety railing structure. Unlike with a traditional design where the base has a full weight of minimum 90 lb (40.8 kg) the system of the invention allows for a complete safety railing structure installation and placement with less weight. Making it easier to install and align. After the system is setup, the paver stones are added in the counterweight receptor of the safety railing base in order to achieve the required full base weight.

The low weight of the base tray makes it very transportable and allows for higher unit quantity to be shipped via a single carrier. The readily available paver stones can be procured local to the site installation from any hardware supply store. Reducing shipping costs, improving logistics and reducing carbon pollution.

Integral part of the system is a sheet metal railing base with a counterweight receptor which accommodates the paver stones and with a rail post receptor which provides means to mount the guardrails via receiving holes and optional toe board via integrated toe board mounting retainers. Both the rail post receptor and toe board mounting retainers are distributed along the base tray such that it is possible to achieve numerous safety railing structure configurations.

As shown in FIGS. 1 to 4, the safety railing structure results from the assembly of railing bases 1, concrete paver stones 3, guardrails 2 and toe boards 4.

Each guardrail 2 comprises of two vertical railing posts 20 and a set of horizontal bars 21, 22. The set of horizontal bars 21, 22 is extended between the two vertical railing posts 20 and comprises a handrail 21 between the upper ends of the two railing posts 20.

As shown in FIGS. 5 to 8, each railing base 1 comprises one rail post receptor 10 and one counterweight receptor 19.

The rail post receptor 10 is configured to accommodate between one and four railing posts 20. The rail post receptor 10 comprises a horizontal upper retainer plate also named upper plate 12 through which four upper receiving holes 11 open towards the top are arranged. Each upper receiving hole 11 is configured to receive by insertion and to hold upright a railing post 20 of a guardrail 2. A horizontal lower retainer plate also named lower plate 13 is arranged within the rail post receptor 10 under the upper plate 12.

The counterweight receptor 19 comprises a hollow bottom to allow for water drainage. The counterweight receptor 19 is configured to accommodate three concrete paver stones 3 each one of same determined square shape and size. The three concrete paver stones 3 are stacked one on top of the other in the counterweight receptor 19. The counterweight receptor 19 is delimited at the bottom by a horizontal soleplate 14 and laterally by four vertical side walls 15, 16, 17, 18 perpendicular to the soleplate 14. The counterweight receptor 19 is open towards the top. The four side walls 15, 16, 17, 18 are adjusted as to border and retain laterally the concrete paver stones 3.

The rail post receptor 10 is arranged along one corresponding side wall, in the instant case the side wall referenced 18. The rail post receptor 10 defines the front side of the railing base 1. The side wall referenced 16 defines the rear side of the railing base 1. The lateral side walls referenced 15 and 17 define the lateral sides of the railing base 1. The railing base comprises toe board mounting retainers 5 configured to receive by insertion and hold upright toe boards 4.

The railing base 1 is fabricated from sheet metal. Preferably, all or most of the walls and panels and soleplate are obtained from one common sheet metal that is cut and bent. The lower plate 13 can be a separate plate that is welded to the rest of the railing base. The horizontal soleplate can be a separate plate that is welded to the rest of the railing base 1 or it can result from a bending of a sheet metal that also forms other parts of the railing base. Practically, some of individual sheet metal components are profile cut and bent (i.e. shaped) to realize a formed shape. Other individual components like the lower plate 13 are profile cut from sheet metal and stay in a flat form. All the individual components are fit together and welded for permeant fastening to realize the final railing base. Post welding the railing base is powder coated or galvanized for corrosion protection.

Figure 9:
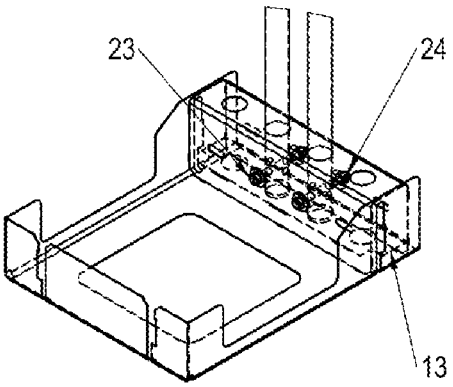
FIG. 9 is a perspective rear view of a railing base without concrete paver stones in the counterweight receptor and with two vertical railing posts of two guardrails inserted and bolted in the rail post receptor.
Figure 10:
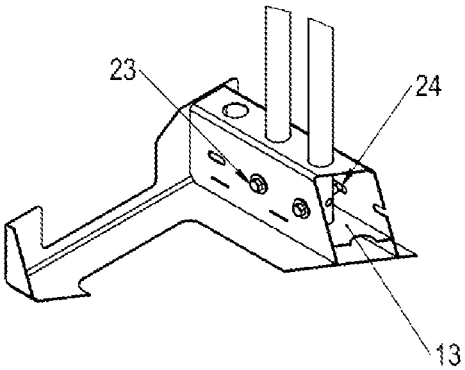
FIG. 10 is a cut view of the railing base of FIG. 9.

The rail post receptor 10 comprises of releasable locking device(s) configured to lock in place the railing post 20 lower end(s) of guardrail(s) 2 inserted in the rail post receptor 10. The releasable locking devices represented in the exemplary FIGS. 9 and 10 are individual and are bolts and nuts 23, 24, that are assembled on site during the setup of the safety railing structure. In other embodiments, clipping means can be used as individual releasable locking devices, Back to FIGS. 1 to 4, each guardrail 2 comprises of two vertical railing posts 20 and a set of horizontal bars 21, 22. The set of horizontal bars 21, 22 is extended between the two vertical railing posts 20 and comprises a handrail 21 between the upper ends of the two railing posts 20.

The guardrails 2 forms vertical barrier element when the two railing posts 20 lower ends of the guardrail 2 are inserted in the rail post receptors 10 of two railing bases 1. Indeed, each upper receiving hole 11 is configured to receive by vertical insertion, a lower end of the railing post 20 of a guardrail 2. In the current instance, the railing post 20 lower end shape is tubular and the upper 11 and lower receiving holes have a shape corresponding to the cross-section shape that of the railing post 20 lower end. The upper and lower receiving holes of the upper and lower plates of the rail post receptor 10 have a slightly larger diameter than that of a railing post 20 in order to ease the insertion of the railing post 20 lower end in the rail post receptor 10 while allowing the guardrail 2 to be maintained vertical.

The invention claimed is:

1. A railing base for a safety railing structure, the railing base comprising:

one rail post receptor and one counterweight receptor, the rail post receptor accommodating between one and four railing posts of a guardrail and the counterweight receptor comprising a hollow bottom to allow for water drainage, the rail post receptor comprising four upper receiving holes open towards the top, each upper receiving hole being configured to receive by insertion and to hold upright a railing post of a guardrail, the counterweight receptor being configured to accommodate concrete paver stones each having the same determined square shape and size, the concrete paver stones being stacked one on top of the other in the counterweight receptor, the counterweight receptor being delimited at the bottom by a horizontal soleplate and laterally by four vertical side walls perpendicular to the soleplate, the four side walls being adjusted as to border and retain laterally the concrete paver stones, the counterweight receptor being open towards the top, the rail post receptor being arranged along one corresponding side wall of the counterweight receptor, the railing base being fabricated from sheet metal, wherein each upper receiving hole is configured to receive by vertical insertion, a lower end of the railing post of a guardrail, the railing post lower end shape being tubular, the upper receiving hole being open toward the top and having a shape corresponding to the cross-section shape that of the railing post lower end, and wherein the rail post receptor is comprised of a horizontal upper retainer plate having the upper receiving holes, the upper plate being horizontal and located at a level above the level of the soleplate.

2. The railing base according to claim 1, wherein the upper plate is at the level of the upper end of the said one corresponding vertical side wall of the counterweight receptor along which the rail post receptor is arranged.

3. A safety railing structure with guardrails and the railing bases of claim 2, wherein each guardrail comprises two vertical railing posts and a set of horizontal bars, the set of horizontal bars being extended between the two vertical railing posts and comprising a handrail between the upper ends of the two railing posts, each guardrail forming a vertical barrier element when the two railing posts lower ends of the guardrail are inserted in the rail post receptors of two railing bases.

4. The railing base according to claim 1, wherein the rail post receptor further comprises, under the upper plate, a horizontal lower retainer plate which has four lower receiving holes, the lower plate being at a level above the level of the soleplate and under the level of the upper plate, the lower receiving holes and upper receiving holes being aligned vertically by pairs and being arranged as to allow a railing post lower end of a guardrail to be inserted into both receiving holes of the pair and be held upright.

5. The railing base according to claim 4, wherein the upper and lower plates of the rail post receptor have receiving holes of a slightly larger diameter than that of a railing post.

6. A safety railing structure with guardrails and the railing bases of claim 5, wherein each guardrail comprises two vertical railing posts and a set of horizontal bars, the set of horizontal bars being extended between the two vertical railing posts and comprising a handrail between the upper ends of the two railing posts, each guardrail forming a vertical barrier element when the two railing posts lower ends of the guardrail are inserted in the rail post receptors of two railing bases.

7. The railing base according to claim 4, wherein the rail post receptor comprises releasable locking devices configured to lock in place the railing post lower end of guardrail inserted in the rail post receptor.

8. The railing base according to claim 7, wherein the releasable locking devices of the rail post receptor are individual devices, each releasable locking device acting on one pair of receiving holes and the railing post lower end inserted into said pair of receiving holes.

9. A safety railing structure with guardrails and the railing bases of claim 8, wherein each guardrail comprises two vertical railing posts and a set of horizontal bars, the set of horizontal bars being extended between the two vertical railing posts and comprising a handrail between the upper ends of the two railing posts, each guardrail forming a vertical barrier element when the two railing posts lower ends of the guardrail are inserted in the rail post receptors of two railing bases.

10. A safety railing structure with guardrails and the railing bases of claim 7, wherein each guardrail comprises two vertical railing posts and a set of horizontal bars, the set of horizontal bars being extended between the two vertical railing posts and comprising a handrail between the upper ends of the two railing posts, each guardrail forming a vertical barrier element when the two railing posts lower ends of the guardrail are inserted in the rail post receptors of two railing bases.

11. A safety railing structure with guardrails and the railing bases of claim 4, wherein each guardrail comprises two vertical railing posts and a set of horizontal bars, the set of horizontal bars being extended between the two vertical railing posts and comprising a handrail between the upper ends of the two railing posts, each guardrail forming a vertical barrier element when the two railing posts lower ends of the guardrail are inserted in the rail post receptors of two railing bases.

12. The railing base according to claim 1, further comprising toe board mounting retainers configured to receive by insertion and hold upright toe boards.

13. A safety railing structure with guardrails and the railing bases of claim 12, wherein each guardrail comprises two vertical railing posts and a set of horizontal bars, the set of horizontal bars being extended between the two vertical railing posts and comprising a handrail between the upper ends of the two railing posts, each guardrail forming a vertical barrier element when the two railing posts lower ends of the guardrail are inserted in the rail post receptors of two railing bases.

14. The railing base according to claim 1, wherein the main faces and plates of the rail post receptor and of the counterweight receptor are made from one common sheet metal that is cut and bent.

15. The railing base according to claim 1, wherein the counterweight receptor is configured to receive and stack three concrete paver stones, each one being of approximative size 406 mm×406 mm×70 mm and of approximative weight 13.6 kg.

16. A safety railing structure with guardrails and railing bases, wherein the railing bases are according to claim 1, wherein each guardrail comprises two vertical railing posts and a set of horizontal bars, the set of horizontal bars being extended between the two vertical railing posts and comprising a handrail between the upper ends of the two railing posts, each guardrail forming a vertical barrier element when the two railing posts lower ends of the guardrail are inserted in the rail post receptors of two railing bases.

17. The safety railing structure according to claim 16, further comprising toe boards.

18. The safety railing structure according to claim 16, wherein the structure is configured for a non-penetrating roof top application.

19. A safety railing structure with guardrails and the railing bases of claim 1, wherein each guardrail comprises two vertical railing posts and a set of horizontal bars, the set of horizontal bars being extended between the two vertical railing posts.

20. A safety railing structure with guardrails and the railing bases of claim 1, wherein each guardrail comprises two vertical railing posts and a set of horizontal bars, the set of horizontal bars being extended between the two vertical railing posts and comprising a handrail between the upper ends of the two railing posts, each guardrail forming a vertical barrier element.

* * * * *